US006398820B1

(12) United States Patent
Merz et al.

(10) Patent No.: US 6,398,820 B1
(45) Date of Patent: Jun. 4, 2002

(54) METHOD FOR WASHING CLOTHES, IN PARTICULAR WORKING CLOTHES

(75) Inventors: Thomas Merz, Hilden; Christine Schnepf, Neuss; Khalil Shamayeli, Duesseldorf, all of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/446,256

(22) PCT Filed: Jun. 12, 1998

(86) PCT No.: PCT/EP98/03543

§ 371 (c)(1),
(2), (4) Date: Feb. 18, 2000

(87) PCT Pub. No.: WO98/59025

PCT Pub. Date: Dec. 30, 1998

(30) Foreign Application Priority Data

Jun. 20, 1997 (DE) ..... 197 26 287

(51) Int. Cl.[7] ..... D06F 31/00; D06F 35/00

(52) U.S. Cl. ..... 8/137; 8/141; 134/10; 134/42; 210/650; 210/257.2

(58) Field of Search ..... 8/137, 141; 134/10, 134/42; 210/650, 257.2

(56) References Cited

U.S. PATENT DOCUMENTS

| | | | | |
|---|---|---|---|---|
| 4,664,839 | A | 5/1987 | Rieck | 252/175 |
| 4,820,439 | A | 4/1989 | Rieck | 252/135 |
| 4,832,862 | A | 5/1989 | Joubert et al. | 252/135 |
| 5,364,552 | A | 11/1994 | Merz et al. | 252/174.22 |
| 5,658,870 | A | 8/1997 | Leu | 510/276 |
| 5,780,420 | A | 7/1998 | Breuer et al. | 510/466 |

FOREIGN PATENT DOCUMENTS

| | | |
|---|---|---|
| DE | 39 30 791 | 3/1991 |
| DE | 43 29 064 | 3/1995 |
| DE | 44 00 024 | 7/1995 |
| DE | 196 07 800 | 9/1997 |
| EP | 0 164 514 | 12/1985 |
| EP | 0 273 377 | 7/1988 |
| FR | FR 2 526 038 | 11/1983 |
| WO | WO 92/05235 | 4/1992 |
| WO | WO92/05235 | 4/1992 |

OTHER PUBLICATIONS

Ash et al., *A Formulary of Detergents and Other Cleaning Agents*. 1980. pp. 255–256.

*Primary Examiner*—Yogendra N. Gupta
*Assistant Examiner*—Brian P. Mruk
(74) *Attorney, Agent, or Firm*—Merchant & Gould P.C.

(57) ABSTRACT

A process for washing laundry is provided in which a washing alkali component and a surfactant component are combined with water to form a wash liquor, the wash liquor is combined with laundry in a standard washing machine for institutional laundries, and the wastewater from the wash is treated by membrane filtration, where the throughflow rate is reduced by less than 10 percent over an operating time of 120 hours. The washing alkali component is composed of an anionic surfactant and a water-soluble silicate; an alkali metal hydroxide and a complexing agent; or an anionic surfactant and water-soluble silicate and an alkali metal hydroxide, a complexing agent, or a mixture of an alkali metal hydroxide and a complexing agent. The surfactant component is composed of a nonionic surfactant selected from the group consisting of $C_{8-18}$ fatty alcohol alkoxylates containing at least 5 alkoxy groups, $C_{8-18}$ fatty alcohol ethoxylates containing at least 7 ethoxy groups, $C_{8-18}$ fatty alcohol ethoxylate/propoxylates containing at least 4 ethoxy groups and at least 2 propoxy groups in the molecule, and mixtures thereof.

27 Claims, No Drawings

METHOD FOR WASHING CLOTHES, IN PARTICULAR WORKING CLOTHES

This application is filed under 35 U.S.C. 371 and based on PCT/EP98/03543, filed Jun. 12, 1998.

BACKGROUND OF THE INVENTION

1. Field of the Invention

This invention relates to a process for washing laundry, more particularly work clothing, in which the laundry is washed with a product combination of an alkali component and a surfactant component in a standard washing machine for institutional laundries and the wastewater is treated in a membrane filtration unit, and to a product combination containing an alkali component and a surfactant component for use in institutional laundries.

2. Discussion of Related Art

Work clothing and other linen from hotels and guesthouses, hospitals, the food industry, for example abattoirs, meat markets, etc. and textiles and work clothing from the automotive sector are mainly washed in institutional laundries. The soils occurring in work clothing and in the institutional sector often lead to particularly heavy pollution of the wastewater. Accordingly, efforts are made to treat the wastewater from institutional laundries before it is discharged into the public effluent system by removing the pollutants.

The pollutants and impurities can be removed, for example, by passing the wastewater through membrane filtration units after the washing process. The already known membrane filtration units have proved to be very effective systems in the treatment of wastewater. However, it has been found that the membranes clog up very quickly in the treatment of wastewater from institutional laundries. Studies have shown that this is due to the surfactants and polymers present in the detergents.

Although the clogged-up membranes can be cleaned with special auxiliaries, complete cleaning generally cannot be achieved by this cleaning process so that the membranes cannot be restored to their original capacity and their useful lives are thus shortened.

DESCRIPTION OF THE INVENTION

International patent application WO 92/05235, for example,

DESCRIPTION OF THE INVENTION describes a liquid nonionic surfactant combination with improved low-temperature stability containing a) 20 to 50% by weight of an alcohol ethoxylate derived from primary linear $C_{12-15}$ alcohols containing on average 2 to 7 ethylene oxide groups (EO),
b) 20 to 50% by weight of an alkoxylate derived from primary $C_{12-15}$ alcohols containing on average 3 to 7 ethylene oxide groups (EO) and 2 to 8 propylene oxide groups (PO),
c) 5 to 50% by weight of an alcohol ethoxylate derived from mixtures of primary linear and 2-methyl-branched $C_{12-15}$ alcohols (oxo alcohols) containing on average 2 to 8 ethylene oxide groups.

However, the problem of membrane clogging could not be completely solved.

The problem addressed by the present invention was to provide a process for washing laundry, more particularly work clothing, in a standard washing machine for institutional laundries and subsequent treatment of the wastewater in membrane units, in which the laundry would be washed with a product combination of surfactant and alkali components which would have substantially the same cleaning performance as the detergents known from the prior art but which, in the treatment of the wastewater in membrane filtration units, would not have any adverse impact on the actual wastewater treatment process, i.e in particular would not lead to clogging of the membranes and hence to a reduction in the throughflow rate. In addition, the throughflow rate in the wastewater treatment process would actually be increased in relation to the throughflow of clean water.

The present invention relates to a process for washing laundry, more particularly work clothing, in which the laundry is washed in a standard washing machine for institutional laundries with a product combination of at least two components, (A) a washing alkali component containing
  (A1) anionic surfactant and water-soluble silicate and/or
  (A2) alkali metal hydroxide and
  (A3) complexing agent and
(B) a surfactant component containing preferably nonionic surfactant, and the wastewater is treated in a membrane filtration unit.

The present invention also relates to a product combination of at least two components, (A) a washing alkali component containing
  (A1) anionic surfactant and water-soluble silicate and/or
  (A2) alkali metal hydroxide and
  (A3) complexing agent and
(B) a surfactant component containing preferably nonionic surfactant, for use in institutional laundries.

It has surprisingly been found that not only is the throughflow rate through the membranes not impaired, it can actually be increased through the use of the product combination according to the invention, in other words the product combination appears to have a cleaning effect on the membranes.

In addition, this positive outcome is not dependent on the membrane material so that standard membranes based on polypropylene, ceramics and carbon may be used with considerable advantage.

The process according to the invention may be carried out in standard washing machines for institutional laundries. No special measures have to be taken in the washing process.

The washing alkali component (A) used in accordance with the invention may be present both in solid form and in liquid form. If component (A) is present in solid form, it preferably contains anionic surfactant and water-soluble silicate (A1) and a complexing agent (A3). If the washing alkali component is added in liquid form, it preferably contains alkali metal hydroxide (A2), more particularly in the form of an aqueous solution, and a complexing agent (A3).

The anionic surfactant used may be any of the anionic surfactants typically used in detergents such as, for example, $C_{8-18}$ alkyl sulfates, $C_{8-18}$ alkyl ether sulfates, $C_{8-18}$ alkane sulfonates, $C_{8-18}$ α-olefin sulfonates, sulfonated $C_{8-18}$ fatty acids, $C_{8-18}$ alkyl benzene sulfonates, sulfosuccinic acid mono- and di-C1-12-alkyl esters, $C_{8-18}$ alkyl polyglycol ether carboxylates, $C_{8-18}$-N-acyl taurides, $C_{8-18}$-N-sarcosinates, $C_{8-18}$ alkyl isethionates and mixtures thereof.

The anionic surfactants are present in a quantity of preferably 1 to 10% by weight and more preferably 2 to 6% by weight, based on the washing alkali component A.

The water-soluble silicates used may be any of the silicates used in detergents. The silicates not only act as a washing alkali, i.e. increase the pH value, they also have builder properties. Suitable water-soluble silicates are both crystalline and amorphous silicate. Crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4, are particularly suitable. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5.yH_2O$ are particularly preferred.

Amorphous sodium silicates with a modulus ($Na_2O:SiO_2$ ratio) of 1:2 to 1:3.3, preferably 1:2 to 1:2.8 and more preferably 1:2 to 1:2.6 are also suitable. Amorphous sodium silicates which dissolve with delay and exhibit multiple wash cycle properties are particularly preferred. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The water-soluble silicates are present in a quantity of preferably 10 to 60% by weight and more preferably 20 to 50% by weight, based on component A.

Suitable alkali metal hydroxides are, in particular, KOH and NaOH, NaOH being particularly preferred. The alkali metal hydroxides may be present in component A in a quantity of 10 to 50% by weight and preferably in a quantity of 15 to 30% by weight, the alkali metal hydroxide generally being present in liquid preparations in the form of an aqueous solution with a concentration of 10 to 50% by weight.

Component A contains one or more complexing agents as a further constituent. The complexing agent(s) used may be any of the usual complexing agents suitable for detergents, salts of polyphosphonic acids, salts of organic polycarboxylic acids, such as citric acid, carboxyaspartic acid and nitrilotriacetic acid and mixtures thereof being particularly suitable. Preferred polyphosphonic acid salts are the neutrally reacting sodium salts of 1-hydroxyethane-1,1-diphosphonic acid, diethylenetriamine pentamethylene phosphonic acid or ethylenediamine tetramethylene phosphonic acid. The complexing agent is used in quantities of preferably 0.1 to 4.0% by weight and more preferably 0.3 to 2.0% by weight. N-(2-hydroxyethyl)-N,N-bis-methylene phosphonic acid (commercially available, for example, under the name of Cublen® R 60 from Zschimmer & Schwarz) and the sodium salt of carboxyaspartic acid (commercially available, for example, under the name of Nervanaid® GBS from Rhône-Poulenc) have proved to be particularly suitable compounds.

Other water-soluble builders, for example phosphates, and soda may also be present as further ingredients in component A.

Suitable phosphates are, in particular, the sodium salts of the orthophosphates, the pyrophosphates and, in particular, the tripoly-phosphates. Their content is generally no more than 60% by weight and is preferably between 10 and 60% by weight and more preferably between 15 and 40% by weight, based on the washing alkali component A.

Another possible ingredient is soda, $Na_2CO_3$, which contributes towards increasing the pH value of the wash liquor. Soda may be present in a quantity of up to 50% by weight, preferably 10 to 50% by weight and more preferably 15 to 30% by weight, based on component A.

Besides the ingredients mentioned, the washing alkali component (A) may contain known additives typically used in such washing alkali compositions, such as co-builders, optical brighteners, dyes and perfumes, optionally small quantities of nonionic surfactants and small quantities of neutral salts, such as sulfates and chlorides in the form of their sodium or potassium salts, providing they do not adversely affect the positive properties of the process.

Thus, it has been found in accordance with the invention that cellulose derivatives which are widely used as redeposition inhibitors in detergents often have a negative effect on the filterability of the wastewater by membranes. Accordingly, component A like component B of the process according to the invention is preferably free from cellulose derivatives such as, for example, carboxymethyl cellulose, hydroxyalkyl cellulose and alkyl cellulose.

In a preferred embodiment, preferably $C_{8-22}$ alcohol alkoxylates (B1) are used as nonionic surfactants of component B. The $C_{8-22}$ alcohol alkoxylates are preferably derived from primary saturated alcohols containing 12 to 18 carbon atoms in which the alcohol component may be linear or 2-methyl-branched or may contain linear and methyl-branched alcohols in the form of the mixtures typically present in oxo alcohol residues.

Preferred primary, saturated and linear alcohols are the mixtures present, for example, in alcohol mixtures of native origin which may be obtained, for example, by the Ziegler synthesis or from native fatty acids by reduction.

The oxo alcohols are normally a mixture of linear and 2-methyl-branched alkanols in which the linear alcohols generally predominate. The alcohol residues contain 12 to 15 and preferably 13 to 14 carbon atoms. Technical mixtures may additionally contain components with 11 to 15 carbon atoms.

The $C_{8-22}$ alcohol alkoxylates preferably contain at least 5 and more preferably at least 7 alkoxy groups. Component B1 contains ethylene oxide groups (EO) and/or propylene oxide groups (PO) as alkoxy groups. If component B1 only contains EO groups, the degree of ethoxylation in a particularly preferred embodiment is at least 7. If both EO groups and PO groups are present, the number of EO groups is preferably 4 to 8 and the number of PO groups is 2 to 8 and, more particularly, 3 to 4. The EO groups and PO groups may be statistically distributed although compounds in which the alcohol component is first completely ethoxylated and then propoxylated, as reproduced by the schematic formula $R\text{-}(EO)_x\text{-}(PO)_y$, are preferably used. In this formula, R stands for the alcohol component, x for the number of EO groups and y for the number of PO groups.

In another embodiment, a mixture (B2) of alcohol ethoxylates containing a) 20 to 80% by weight of alcohol alkoxylates derived from primary linear or 2-methyl-branched $C_{12-22}$ alcohols containing on average 5 or more ethylene oxide groups (EO) and b) 80 to 20% by weight of alcohol alkoxylates derived from primary linear or 2-methyl-branched $C_{12-22}$ alcohols (oxo alcohols) containing on average 4 to 8 ethylene oxide groups and 3 to 8 propylene oxide groups (PO) is used as the surfactant component.

In one preferred embodiment, surfactant component B contains the fatty alcohol alkoxylate in a quantity of preferably 50 to 90% by weight, based on component B, and between 10 and 50% by weight of other typical ingredients which increase washing performance and do not adversely affect the treatment of the wastewater in membrane filtration units.

Component B may advantageously contain one or more $C_{1-4}$ alkyl alcohols present in a quantity of preferably 2 to 10% by weight, based on component B, as a further component. Particularly preferred $C_{1-4}$ alkyl alcohols are methanol and ethanol.

Washing performance in the process according to the invention may be further increased by adding one or more fatty alcohols as detergency boosters to surfactant component B. Suitable fatty alcohols are in particular fatty alcohols containing 8 to 18 carbon atoms and the mixtures thereof obtainable from naturally occurring fats and oils.

The fatty alcohols may be present in a quantity of up to 20% by weight, preferably between 5 and 20% by weight and more preferably between 10 and 15% by weight, based on surfactant component B.

Surfactant component B may be water-free or may contain up to 20% by weight and preferably 5 to 15% by weight of water. So far as metering and storage stability are concerned, the water content is of secondary importance. However, since the nonionic surfactants B1 are technical products which may be obtained and supplied in various qualities and purities, it can happen that the concentrates turn cloudy or even form gel-like precipitates where certain technical product batches are used. Such clouding and precipitates are reliably avoided by the addition of water, additions of 5 to 10% by weight generally being sufficient for this purpose.

The mixtures may contain other additives providing it is guaranteed that they are soluble and do not affect the advantageous properties of the concentrates. Such additives include, in particular, dyes and perfumes with which the color and -odor, respectively, of the mixtures are masked. Although basically other solvents may be added, they are generally not necessary.

Surfactant component B normally behaves like a Newtonian liquid, i.e. its viscosity is independent of the shear forces applied. Corresponding mixtures are therefore easy to pump and meter, their viscosity undergoing relatively little change as a function of temperature. Even after several months' storage in a conditioning cabinet at temperatures repeatedly alternating between −10° C. and +40° C., they remain stable in storage, i.e. show no tendency to separate. The concentrates have a liquid consistency at least to 0C. They may be present in liquid or solid form between −10° C. and 0° C. Even the concentrates present in solid form at those temperatures give clear homogeneous liquids on thawing. These properties make them particularly suitable for fully automatic metering in institutional laundries.

Other suitable product additives are optical brighteners, enzymes, bleaching agents from the class of per compounds, which are normally used together with activators, active chlorine compounds and dyes and perfumes.

The process according to the invention is particularly suitable for washing heavily soiled work clothing and is distinguished by high cleaning performance against soils containing mineral oil.

In one preferred embodiment, at least one quaternary ammonium compound is added to the laundry in the final rinse. Suitable quaternary ammonium compounds are any ammonium compounds which do not clog the membrane during the wastewater treatment process, didecyl dimethyl ammonium chloride having proved to be particularly suitable. The quaternary ammonium compound is added to the final rinse in a quantity of preferably up to 10 g/l, more preferably between 0.05 and 2 g/l and most preferably between 0.1 and 1 g/l rinse water.

According to the invention, the wastewater accumulating from the washing process, including the rinses, if any, is treated by passage through a membrane filtration unit. In one preferred embodiment, the wastewater is passed through several membranes arranged in tandem. The wastewater and the prepurified wastewater may also be repeatedly passed through one membrane. The number of membranes arranged in tandem is normally determined as a function of the volume of water to be treated per unit of time and depends upon the size of the membrane.

The wastewater may be passed or circulated through the membranes until the water is sufficiently clean. In order to reduce the costs of the washing process as a whole and particularly the water demand, the water cleaned in this way by the membranes may be used as required for the pre-wash and, depending on the quality of the membrane, even for the final rinse and/or for the first or second rinse.

The residue obtained from the membrane filtration process may be disposed of as waste in known manner.

EXAMPLES

Example 1 (invention)

Work clothing was washed in a wash liquor containing 0.33 g/l of a washing alkali component A and 0.16 g/l of a surfactant component B. These products had the following composition (in % by weight):

| | | |
|---|---|---|
| A | sodium triphosphate | 20.0 |
| | sodium alkyl benzenesulfonate | 2.5 |
| | sodium silicate ($SiO_2$:$Na_2O$ = 1:1) | 47.0 |
| | acrylic acid/maleic acid copolymer as Na salt | 2.0 |
| | Na hydroxyethane diphosphonate | 0.4 |
| | sodium carbonate | 25.0 |
| | $C_{12/14}$ fatty alcohol + 5 EO + 4 PO | 1.5 |
| | rest water, perfume, optical brightener | |
| B | $C_{12/14}$ fatty alcohol + 5 EO + 4 PO | 75.0 |
| | isotridecanol + 5 EO | 21.0 |
| | rest perfume and water | |

The wastewater accumulating after the washing process was adjusted to a pH value of 8 and, with a temperature of ca. 45° C., was filtered through a Microdyn polypropylene membrane (pore diameter 0.2 $\mu$m). The entry pressure was 0.8 bar and the exit pressure 0.4 bar.

For comparison, the throughflow of clean water at 20° C. was determined before the solution was passed through (t=o) and on completion of the test (t=∞).

Example 2 (comparison)

An aqueous solution containing 0.05% by weight of a conventional laundry detergent with the following composition was tested as in Example 1.

Comparison product:

88% by weight of a sodium citrate/sodium gluconate mixture

11% by weight of a carboxymethyl cellulose/methyl cellulose mixture

1% by weight of nonionic surfactant.

The results are set out in the following Table:

| Example 1 | | Example 2 | |
|---|---|---|---|
| Time/mins. | L/hm$^2$ | Time/mins. | L/hm$^2$ |
| 0 | 3500 (water value) | 0 | 3500 (water value) |
| 1 | 3590 | 5 | 2800 |
| 5 | 3510 | 5 | 2380 |
| 15 | 3500 | 15 | 1960 |
| 30 | 3490 | 30 | 1540 |
| 45 | 3300 | 45 | 1420 |
| 0 | 3290 | 60 | 1380 |
| 75 | 3260 | 75 | 1260 |
| 90 | 3260 | 90 | 240 |
| 105 | 3210 | — | — |
| 120 | 3210 | — | — |
| ∞ | 3400 (water value) | ∞ | 1400 (water value) |

It is clear from the tests that the performance of the membrane in Example 1 (invention) showed hardly change from its performance using clean water. On the other hand, the performance of the membrane in Example 2 (comparison) deteriorated continuously and could not be regenerated even by rinsing with water.

What is claimed is:

1. A process for washing laundry comprising:

1) forming a wash liquor comprising:

(A) a washing alkali component comprising:

(A1) an anionic surfactant and a water-soluble silicate;

(A2) an alkali metal hydroxide and a complexing agent; or (A3) the anionic surfactant and water-soluble silicate of (A1) and an alkali metal hydroxide, a complexing agent, or a mixture of an alkali metal hydroxide and a complexing agent; and (B) a surfactant component comprising a nonionic surfactant selected from the group consisting of $C_{8-18}$ fatty alcohol alkoxylates containing at least 5 alkoxy groups, $C_{8-18}$ fatty alcohol ethoxylates containing at least 7 ethoxy groups, $C_{8-18}$ fatty alcohol ethoxylate/propoxylates containing at least 4 ethoxy groups and at least 2 propoxy groups in the molecule, and mixtures thereof;

2) contacting said wash liquor with laundry in a standard washing machine for institutional laundries; and 3) treating wastewater containing the wash liquor after laundry contact by membrane filtration, wherein the throughflow rate is reduced by less than 10 percent over an operating time of 120 hours.

2. The process of claim 1 wherein component (A) comprises 1 to 10 percent by weight of said anionic surfactant.

3. The process of claim 2 wherein component (A) comprises 2 to 6 percent by weight of said anionic surfactant.

4. The process of claim 1 wherein said anionic surfactant comprises $C_{8-18}$ alkyl sulfates, $C_{8-18}$ alkyl ether sulfates, $C_{8-18}$ alkane sulfonates, $C_{8-18}$ α-olefin sulfonates, sulfonated $C_{8-18}$ fatty acids, $C_{8-18}$ alkyl benzene sulfonates, sulfosuccinic acid mono- and di-$C_{1-12}$-alkyl esters, $C_{8-18}$ alkyl polyglycol ether carboxylates, $C_{8-18}$-N-acyl taurides, $C_{8-18}$-N-sarcosinates, $C_{8-18}$ alkyl isethionates, or mixtures thereof.

5. The process of claim 1 wherein component A comprises 10 to 60 percent by weight of said water-soluble silicate.

6. The process of claim 5 wherein component A comprises 20 to 50 percent by weight of said water-soluble silicate.

7. The process of claim 1 wherein said water-soluble silicate is selected from the group consisting of crystalline layer-form sodium silicates corresponding to the general formula $NaMSi_xO_{2x+1}.yH_2O$, wherein M is sodium or hydrogen, x is a number of from 1.9 to 4, and y is a number of from 0 to 20; amorphous sodium silicates with a modulus $Na_2O$:$SiO_2$ ratio of 1:2 to 1:3.3; and mixtures thereof.

8. The process of claim 7 wherein in said formula, x is 2, 3, or 4.

9. The process of claim 7 wherein said amorphous sodium silicates have a modulus of 1:2 to 1:2.8.

10. The process of claim 9 wherein said amorphous sodium silicates have a modulus of 1:2 to 1:2.6.

11. The process of claim 1 wherein component A comprises 10 to 50 percent by weight of said alkali metal hydroxide.

12. The process of claim 11 wherein component A comprises 15 to 30 percent by weight of said alkali metal hydroxide.

13. The process of claim 1 wherein said complexing agent is selected from the group consisting of polyphosphonic acids, diethylene triamine pentamethylene phosphonic acid, ethylene diamine tetramethylene phosphonic acid, N-(2-hydroxyethyl)-N,N-bis-methylene phosphonic acid and salts thereof, carboxyaspartic acid, and salts thereof.

14. The process of claim 13 wherein said polyphosphonic acid comprises 1-hydroxyethane-1,1-diphosphonic acid.

15. The process of claim 1 wherein component A comprises 0.1 to 4 percent by weight of said complexing agent.

16. The process of claim 15 wherein component A comprises 0.3 to 2 percent by weight of said complexing agent.

17. The process of claim 1 wherein said nonionic surfactant comprises:

(a) 20 to 80 percent by weight of alcohol alkoxylates derived from primary linear or 2-methyl-branched $C_{12-22}$ alcohols containing on average 5 or more ethylene oxide groups; and (b) 80 to 20 percent by weight of alcohol alkoxylates derived from primary linear or 2-methyl-branched $C_{12-22}$ alcohols containing an average of 4 to 8 ethylene oxide groups and 3 to 8 propylene oxide groups.

18. The process of claim 1 wherein said surfactant component (B) comprises from 2 to 10 percent by weight of one or more $C_{1-4}$ alkyl alcohols, based on component B.

19. The process of claim 18 wherein said $C_{1-4}$ alkyl alcohols comprise methanol, ethanol, or a mixture thereof.

20. The process of claim 1 wherein said surfactant component (B) comprises 5 to 20 percent by weight of $C_{8-22}$ fatty alcohol, based on component B.

21. The process of claim 1 wherein component B comprises up to 20 percent by weight of water.

22. The process of claim 21 wherein component B comprises 5 to 15 percent by weight of water.

23. The process of claim 1 wherein component s A and B are free from cellulose derivatives.

24. The process of claim 1 further comprising rinsing the laundry after washing, wherein up to 10 g/l of a quaternary ammonium compound is added in the final rinse.

25. The process of claim 24 wherein 0.05 to 2 g/l of said quaternary ammonium compound is added in the final rinse.

26. The process of claim 25 wherein 0.1 to 1 g/l of said quaternary ammonium compound is added in the final rinse.

27. The process of claim 24 wherein said quaternary ammonium compound comprises didecyl dimethyl ammonium chloride.

* * * * *

UNITED STATES PATENT AND TRADEMARK OFFICE

CERTIFICATE OF CORRECTION

PATENT NO. : 6,398,820 B1
DATED : June 4, 2002
INVENTOR(S) : Merz et al.

It is certified that error appears in the above-identified patent and that said Letters Patent is hereby corrected as shown below:

Column 1,
Line 51, delete "DESCRIPTION OF THE INVENTION"

Column 3,
Line 1, "di-C1-12-alkyl esters" should read -- di-$_{C1-12}$-alkyl esters --

Column 6,
Line 7, delete "-" before the word "odor"

Signed and Sealed this

Fifteenth Day of October, 2002

*Attest:*

*Attesting Officer*

JAMES E. ROGAN
*Director of the United States Patent and Trademark Office*